US008505326B2

(12) United States Patent
An et al.

(10) Patent No.: US 8,505,326 B2
(45) Date of Patent: Aug. 13, 2013

(54) ICE MAKING APPARATUS WITH WATER SPILLAGE PREVENTER AND REFRIGERATOR HAVING THE SAME

(75) Inventors: Jae Koog An, Gwangju (KR); Jung Rae Kim, Seoul (KR); Jong Yeob Kim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1064 days.

(21) Appl. No.: 12/078,866

(22) Filed: Apr. 7, 2008

(65) Prior Publication Data

US 2008/0295537 A1 Dec. 4, 2008

(30) Foreign Application Priority Data

Jun. 4, 2007 (KR) ..... 10-2007-0054616

(51) Int. Cl.
*F25C 1/22* (2006.01)
*F25C 1/00* (2006.01)
*F25C 5/10* (2006.01)

(52) U.S. Cl.
USPC ..... 62/356; 62/347; 62/353; 62/340

(58) Field of Classification Search
USPC ..... 62/340, 353, 347, 356; 12/340, 12/353
See application file for complete search history.

(56) References Cited

U.S. PATENT DOCUMENTS 5,992,167 A * 11/1999 Hill et al. ..... 62/188
2006/0207282 A1* 9/2006 Visin et al. ..... 62/351

FOREIGN PATENT DOCUMENTS

| | | |
|---|---|---|
| CN | 1314933 | 5/2007 |
| KR | 10-2004-0102569 | 12/2004 |
| KR | 10-2005-0022094 | 3/2005 |
| KR | 10-2006-0098057 | 9/2006 |

OTHER PUBLICATIONS

Chinese Office Action dated Dec. 31, 2010, issued in Chinese Patent Application No. 200810092977.5.

* cited by examiner

*Primary Examiner* — Frantz Jules
*Assistant Examiner* — Cassey D Bauer
(74) *Attorney, Agent, or Firm* — Staas & Halsey LLP

(57) ABSTRACT

An ice making apparatus which includes an ice making tray to produce ice and an ejector rotatably disposed at the ice making tray, including a plurality of ice making cells formed in the ice making tray, wherein each of the ice making cells includes a freezing portion in which ice is produced and a buffering portion which is formed as a specified space at one side of the freezing portion to prevent water of the freezing portion from flowing out of the ice making tray. Accordingly, even in a refrigerator having the ice making apparatus installed on a rear surface of the door, the ice making apparatus can permanently provide an effect of preventing water inside the ice making cells from flowing out of the ice making tray due to an opening/closing operation of the door.

19 Claims, 9 Drawing Sheets

ICE MAKING APPARATUS WITH WATER SPILLAGE PREVENTER AND REFRIGERATOR HAVING THE SAME

CROSS-REFERENCE TO RELATED APPLICATIONS

This application claims the priority benefit of Korean Patent Application No. 2007-0054616, filed on Jun. 4, 2007 in the Korean Intellectual Property Office, the disclosure of which is incorporated herein by reference.

BACKGROUND

1. Field

Embodiments relate to an ice making apparatus and a refrigerator having the same, and, more particularly, to an ice making apparatus having a structure capable of preventing a water outflow of an ice making tray mounted on a rear surface of a door and a refrigerator having the same.

2. Description of the Related Art

Generally, a refrigerator includes a cooling chamber which cools and stores various food products and beverages and a freezing chamber which freezes and stores frozen food products. The cooling chamber and the freezing chamber are defined as separate spaces by a partition wall and are opened and closed by different doors.

Recently, a refrigerator having an ice making apparatus in a cooling chamber or a freezing chamber to automatically form ice has been developed. Lately, a refrigerator having an ice making apparatus which is installed at a door has been developed to minimize a reduction of a storage space inside the cooling chamber or the freezing chamber due to installation of the ice making apparatus.

An example of the refrigerator having an ice making apparatus which is installed at a door and capable of efficiently using a space is disclosed in Korean Patent Laid-open Publication No. 10-2004-102569.

However, the refrigerator disclosed in the Publication has a problem that liquid water which has not been solidified in the ice making apparatus may flow out of the ice making apparatus due to an opening/closing operation of the door since the ice making apparatus is mounted on the door.

In order to solve such a problem, Korean Patent Laid-open Publication No. 10-2005-22094 discloses an automatic ice making apparatus of a refrigerator capable of preventing an outflow of water accommodated in an ice making chamber.

The automatic ice making apparatus of the refrigerator disclosed in the Publication includes an approximately semi-cylindrical ice making chamber in which ice is produced; a motor which is disposed at one lengthwise side of the ice making chamber; an ejector which is withdrawn from a motor shaft of the motor and is installed at a lengthwise central portion of the ice making chamber; a water outflow prevention wall which is disposed at one longer side portion of the ice making chamber to be extended upward; and a water outflow prevention slide having a downward inclined upper surface which covers an opening of the ice making chamber from the other longer side portion of the ice making chamber to the vicinity of the rotation shaft.

In the automatic ice making apparatus of the refrigerator disclosed in the Publication, however, since the motor should be operated to alternately rotate forward and backward such that the ejector is not in direct contact with the water outflow prevention slide, there is a problem that the motor has a complicated control structure.

Further, an ice making apparatus of a refrigerator having another structure to prevent a water outflow of the ice making apparatus is disclosed in Korean Patent Laid-open Publication No. 10-2006-98057.

The ice making apparatus of the refrigerator disclosed in the Publication includes an ice making mold which is provided to be mountable on the inside of the door of the refrigerator and has a plurality of cavities defined by partition walls to form a row in a width direction of the door; an ejector having ejector pins which are provided for the respective cavities and fixed to the ejector shaft; and a water outflow prevention plate having a plate body which is disposed at an upper portion of a main wall of the ice making mold facing an inner surface of the door and covers a specified area of an upper portion of the cavities to prevent an outflow of water in the cavities, wherein an ejector pin passing portion is formed on the plate body for each of the cavities such that each of the rotating ejector pins passes through the ejector pin passing portion.

The water outflow prevention plate of the ice making apparatus disclosed in the Publication is cast of an elastic material such as silicon such that it is restored to an initial state after easily passing the ejector pins therethrough to prevent an outflow of water. The water outflow prevention plate has first slits which are formed to pass the ejector pins therethrough and second slits which are formed to disperse the concentrated stress exerted on the first slits.

However, the slits are contacted with water due to a water flow caused by the opening/closing of the door or the like. In this case, water flows out through the first slits, the second slits and the like. The water which has flowed out through the first and second slits and the like and stood on the water outflow prevention plate is frozen on the surface of the water outflow prevention plate. When the ejector pins pass through the first slits of the water outflow prevention plate with the frozen water, there is a problem that cracks are generated in the slits. Thus, the durability of the water outflow prevention plate is greatly reduced, and after a specified period of time has passed, the water outflow prevention plate cannot perform a function of preventing an outflow of water.

SUMMARY

Embodiments have been made in order to solve the above problems. It is an aspect of embodiments to provide an ice making apparatus having a structure capable of preventing a water outflow of the ice making tray and a refrigerator having the same.

It is another aspect of embodiments to provide an ice making apparatus capable of improving durability of a structure which performs a function of preventing a water outflow and a refrigerator having the same.

In accordance with an aspect of an embodiment, there is provided an ice making apparatus which includes an ice making tray to produce ice and an ejector rotatably disposed at the ice making tray, comprising: a plurality of ice making cells formed in the ice making tray, wherein each of the ice making cells includes a freezing portion in which ice is produced and a buffering portion which is formed as a specified space at one side of the freezing portion to prevent water of the freezing portion from flowing out of the ice making tray.

An ice making apparatus including at least one ice making cell formed in an ice making tray, wherein each of the ice making cells includes a freezing portion in which ice is produced and a buffering portion which is formed as a specified space at one side of the freezing portion to prevent water of the freezing portion from flowing out of the ice making tray.

The freezing portion may have a specified radius and the buffering portion is disposed at the outside of the radius of the freezing portion.

The ice making apparatus may further include a buffering portion cover disposed to have a specified width and close an upper portion of the buffering portion in order to prevent a water outflow of the ice making tray.

The ice making apparatus may further include an ejector which is rotatably disposed at the ice making tray.

The ice making apparatus may further include a tray cover which guides ice separated from the ice making cells by the ejector to an outside of the ice making tray, wherein the buffering portion cover is formed at the tray cover.

The ice making apparatus may further include a water outflow prevention member which is disposed between the tray cover and the ice making tray to pass the ejector and is restored after passing the ejector to prevent water from passing therethrough.

A cutaway portion may be formed on the water outflow prevention member to pass the ejector and a groove portion is formed at one side of the cutaway portion to prevent the cutaway portion from being torn and reintroduce water remaining on an upper surface of the water outflow prevention member into the ice making tray.

The tray cover may include a rib to prevent water from flowing out through the groove portion.

The freezing portion and the buffering portion may be cast as a single body.

The buffering portion may have an arc shape having a curvature radius which is smaller than a curvature radius of the freezing portion.

The buffering portion may have an L-shape.

The buffering portion may have a stepped shape.

In accordance with another aspect of an embodiment, there is provided an ice making apparatus including an ice making tray to produce ice; an ejector which is rotatably disposed at the ice making tray; a buffering portion which is disposed at the ice making tray to temporarily store a specified portion of water of the ice making tray; and a buffering portion cover which is disposed at an upper portion of the buffering portion to prevent water from flowing out of the ice making tray.

The buffering portion and the buffering portion cover may be disposed at an outside of a rotation radius of the ejector so as not to interfere with a rotation of the ejector.

The ice making apparatus may further include a tray cover which guides ice to an outside of the ice making tray by the ejector, wherein the buffering portion cover is formed on the tray cover.

The ice making apparatus may further include a water outflow prevention member which is disposed between the tray cover and the ice making tray to pass the ejector and is restored after passing the ejector to prevent water from passing therethrough.

A cutaway portion may be formed on the water outflow prevention member to pass the ejector and a groove portion is formed at one side of the cutaway portion to prevent the cutaway portion from being torn and reintroduce water remaining on an upper surface of the water outflow prevention member into the ice making tray.

In accordance with yet another aspect of an embodiment, there is provided an ice making apparatus including an ice making tray to produce ice; an ejector which is rotatably disposed at the ice making tray; a buffering portion which is disposed at the ice making tray to temporarily store a specified portion of water of the ice making tray; a tray cover which guides ice to an outside of the ice making tray; and a water outflow prevention member which is disposed between the tray cover and the ice making tray to pass the ejector and is restored after passing the ejector to prevent water from passing therethrough.

The tray cover may include a buffering portion cover which closes an upper portion of the buffering portion to prevent water from flowing out of the ice making tray.

In accordance with yet another aspect of an embodiment, there is provided a refrigerator including a storage chamber, a door to open and close the storage chamber and an ice making apparatus disposed at the door to manufacture ice, wherein the ice making apparatus includes an ice making tray to produce ice; and a buffering portion which is provided at the ice making tray and formed as a specified space to prevent a water outflow of the ice making tray.

The ice making apparatus may further include a buffering portion cover which is disposed at an upper portion of the buffering portion to prevent water from flowing out of the ice making tray.

The buffering portion and the buffering portion cover may be disposed at an outside of a rotation radius of the ejector so as not to interfere with a rotation of the ejector.

The ice making apparatus may further include a tray cover which guides ice to be discharged to an outside of the ice making tray, and the buffering portion cover may be formed on the tray cover.

The ice making apparatus may further include a water outflow prevention member which is disposed between the tray cover and the ice making tray to pass the ejector and is restored after passing the ejector to prevent water from passing therethrough.

BRIEF DESCRIPTION OF THE DRAWINGS

These and/or other aspects, features, and advantages of exemplary embodiments will become apparent and more readily appreciated from the following description of exemplary embodiments, taken in conjunction with the accompanying drawings, of which.

DETAILED DESCRIPTION OF EMBODIMENTS

Figure 1:
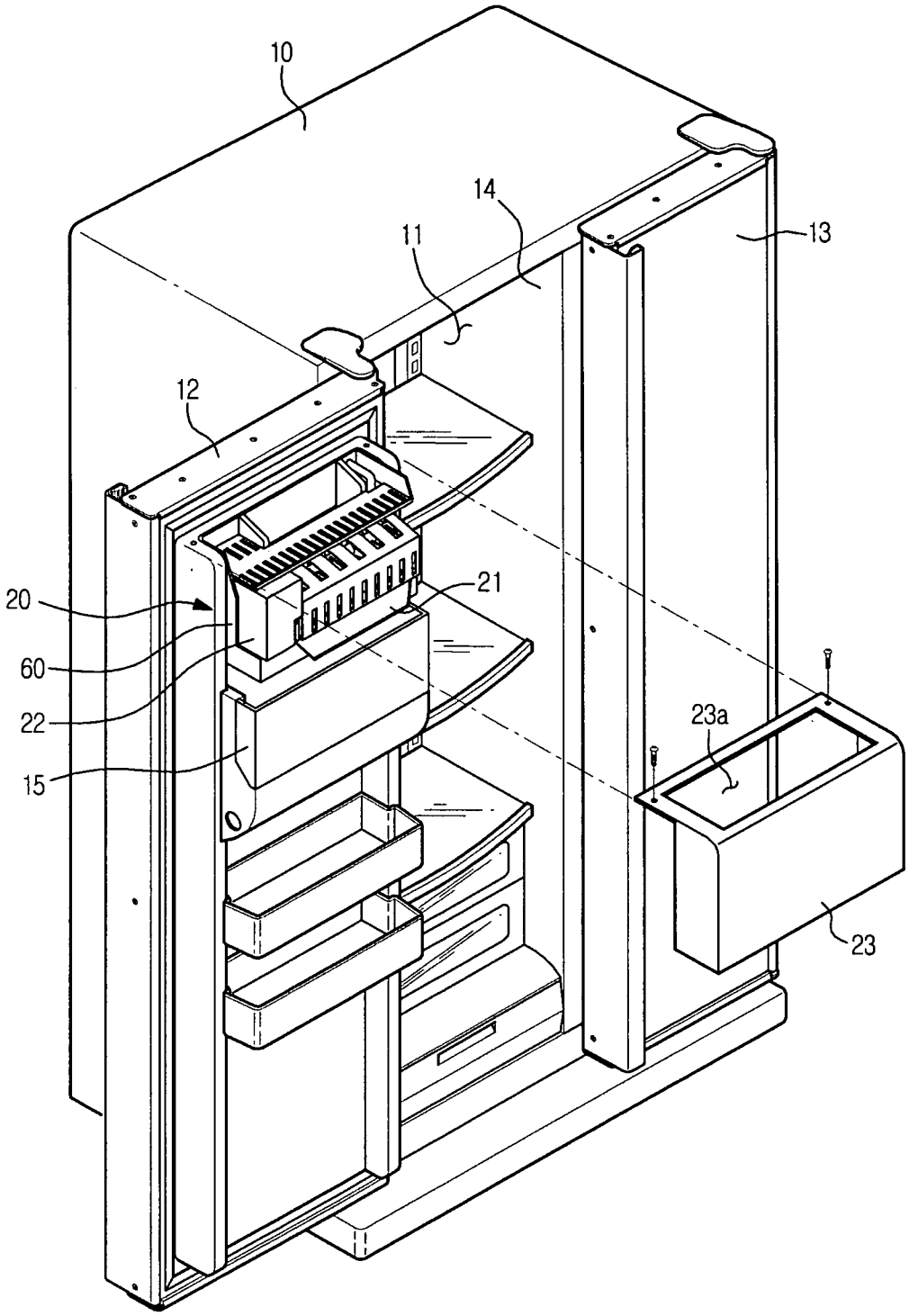
FIG. 1 illustrates a perspective view showing a refrigerator according to an exemplary embodiment.

Reference will now be made in detail to exemplary embodiments, examples of which are illustrated in the accompanying drawings, wherein like reference numerals refer to like elements throughout. Exemplary embodiments are described below by referring to the figures.

FIG. 1 illustrates a perspective view showing a refrigerator according to an exemplary embodiment.

As shown in FIG. 1, the refrigerator according to an exemplary embodiment includes a main body 10 which has a freezing chamber 11 and a cooling chamber (not shown), a freezing chamber door 12 and a cooling chamber door 13 which are rotatably coupled to the main body 10 to open and close the freezing chamber 11 and the cooling chamber (not shown), an ice making apparatus 20 which is disposed at the freezing chamber door 12 to produce ice, and an ice bank 15 which stores the ice produced by the ice making apparatus 20.

The main body 10 has an open front side, and the inside of the main body 10 is segmented into the freezing chamber 11 and the cooling chamber (not shown) by a partition wall 14. The freezing chamber door 12 and the cooling chamber door 13 are hinge-coupled to the main body 10 to open and close the freezing chamber 11 and the cooling chamber (not shown), respectively.

The refrigerator according to an exemplary embodiment includes an evaporator, a compressor, an expansion device and a condenser to form a refrigeration cycle. Since the configuration of the refrigeration cycle is a generally well-known technology, the description thereof is omitted.

Further, the refrigerator according to an exemplary embodiment may refrigerate both the freezing chamber 11 and the cooling chamber (not shown) using a single evaporator, or may refrigerate the freezing chamber and the cooling chamber, respectively, using a plurality of evaporators.

The ice bank 15 is installed at the freezing chamber door 12 with the ice making apparatus 20.

The ice bank 15 is disposed below the ice making apparatus 20, and the ice made in the ice making apparatus 20 falls and is stored in the ice bank 15. Further, although not shown in the drawings, an ice transfer device is disposed in the ice bank 15 to transfer the stored ice toward a dispenser (not shown) according to signals input by a user. Since the ice transfer device and the dispenser are commonly used ones, the drawings and detailed description thereof are omitted.

Further, the ice transfer device disposed in the ice bank 15 may be omitted. In this case, the dispenser may be also omitted such that the user can directly take ice out of the ice bank 15.

Figure 2:
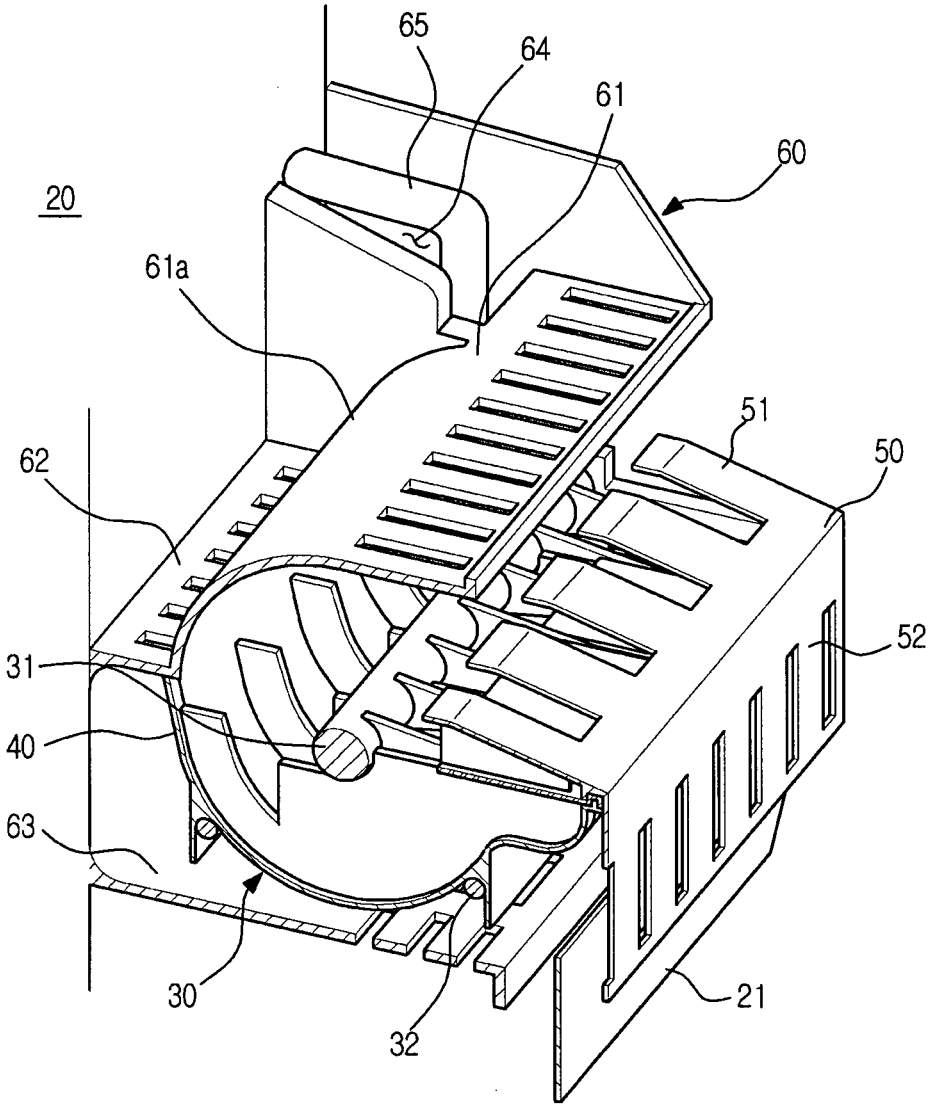
FIG. 2 illustrates a cutaway perspective view showing an ice making apparatus of the refrigerator according to an exemplary embodiment.

FIG. 2 illustrates a cutaway perspective view showing the ice making apparatus of the refrigerator according to an exemplary embodiment.

As shown in FIG. 2, the ice making apparatus 20 includes an ice maker 30 which produces ice and transfers the produced ice to the ice bank 15, a cool air guiding unit 60 which guides cool air for making ice to the ice maker 30, an ice fullness lever 21 which measures the amount of the ice stored in the ice bank 15, and a controller 22 (see FIG. 1) which controls operations of components of the ice making apparatus 20.

The ice maker 30 includes an ice making tray 40 which forms an ice producing space, an ejector 31 which separates the ice made in the ice making tray 40 from the ice making tray 40 to transfer the ice to the ice bank 15, and a tray cover 50 which guides the ice, separated from the ice making tray 40 by the operation of the ejector 31, to the ice bank 15.

The tray cover 50 guides the ice discharged from the ice making tray 40 by the ejector 31 to the ice bank 15. The tray cover 50 includes an ice guiding portion 51 having ejector grooves 51*a* formed so as not to interfere with the rotation of the ejector 31, and a lever protecting portion 52 which protects the ice fullness lever 21 such that the ice fullness lever 21 does not interfere with the ice stored in the ice bank 15.

A heater 32 is disposed at a lower portion of the ice making tray 40 to heat the ice making tray 40 such that the ice can be easily separated from a bottom surface of the ice making tray 40. The heater 32 heats the bottom surface of the ice making tray 40 before the ejector 31 is operated such that the ice can be smoothly discharged by the ejector 31.

The cool air guiding unit 60 which guides cool air to the ice maker 30 is coupled to an inner upper portion of the freezing chamber door 12 while covering the ice maker 30.

The cool air guiding unit 60 includes an upper distribution plate 61 which introduces a portion of the supplied cool air into an upper portion of the ice making tray 40 of the ice maker 30 and guides the other portion of the cool air toward a rear distribution plate 62, the rear distribution plate 62 which guides the cool air guided by the upper distribution plate 61 toward the lower side of the ice making tray 40, and a lower distribution plate 63 which allows the cool air introduced to the lower side of the ice making tray 40 by the rear distribution plate 62 to refrigerate the ice making tray 40 and also flow into the ice bank 15, wherein the upper, rear and lower distribution plates 61, 62 and 63 are formed as a single body.

The ice fullness lever 21 is disposed between the front side of the ice making tray 40 and the tray cover 50. The ice fullness lever 21 detects a storage amount of the ice filled in the ice bank 15 to store a proper amount of ice in the ice bank 15. The ice fullness lever 21 detects an ice storage amount of the ice bank 15 while elevating in front of the ice making tray 40. Various configurations in which the ice fullness lever 21 elevates with the rotation of the ejector 31 are disclosed in the conventional documents. Since the ice fullness lever included in an exemplary embodiment is a commonly used one, the description thereof is omitted.

An ice making cover 23 (see FIG. 1) is coupled to the freezing chamber door 12 to cover the ice making tray 40 and the cool air guiding unit 60, thereby defining the ice making apparatus 20 in the freezing chamber 11. A cool air supply port 23*a* is formed at an upper portion of the ice making cover 23 to introduce cool air for making ice toward the upper distribution plate 61. A lower portion of the ice making cover 23 is slightly spaced from an upper portion of the ice bank 15 to discharge cool air inside the ice making apparatus 20 between the ice making cover 23 and the ice bank 15 toward the freezing chamber 11.

The controller 22 (see FIG. 1) entirely controls the ice making apparatus 20. For example, when the ice is made, the controller 22 operates a motor (not shown) to transfer the ice to the ice bank 15 disposed at the lower side. When the ice fullness lever 21 detects that the ice bank 15 is filled with the ice, the controller 22 stops an ice making operation. Further, the controller 22 may command water supply to the ice making tray 40.

Since the ice making apparatus according to an exemplary embodiment is mounted on a rear surface of the door, water accommodated in the ice making tray 40 may flow due to opening/closing of the door 12 and some flowing water may flow out of the ice making tray 40. Accordingly, the ice making apparatus 20 according to an exemplary embodiment has a water outflow prevention configuration to prevent the outflow of water. Hereinafter, the water outflow prevention configuration of the ice making apparatus according to an exemplary embodiment will be described in detail.

Figure 3:
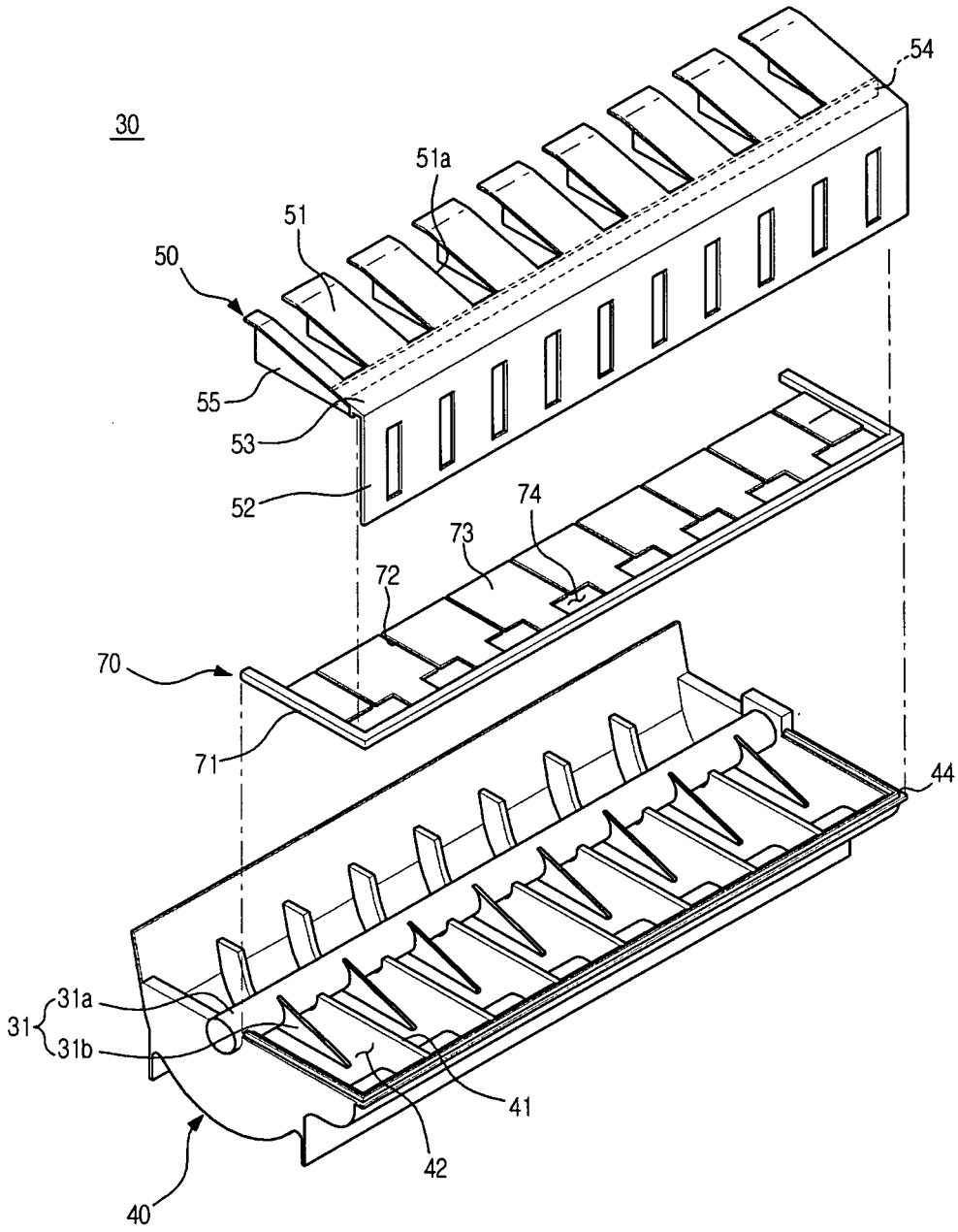
FIG. 3 illustrates an exploded perspective view showing an ice maker of the ice making apparatus of FIG. 2.
Figure 4:
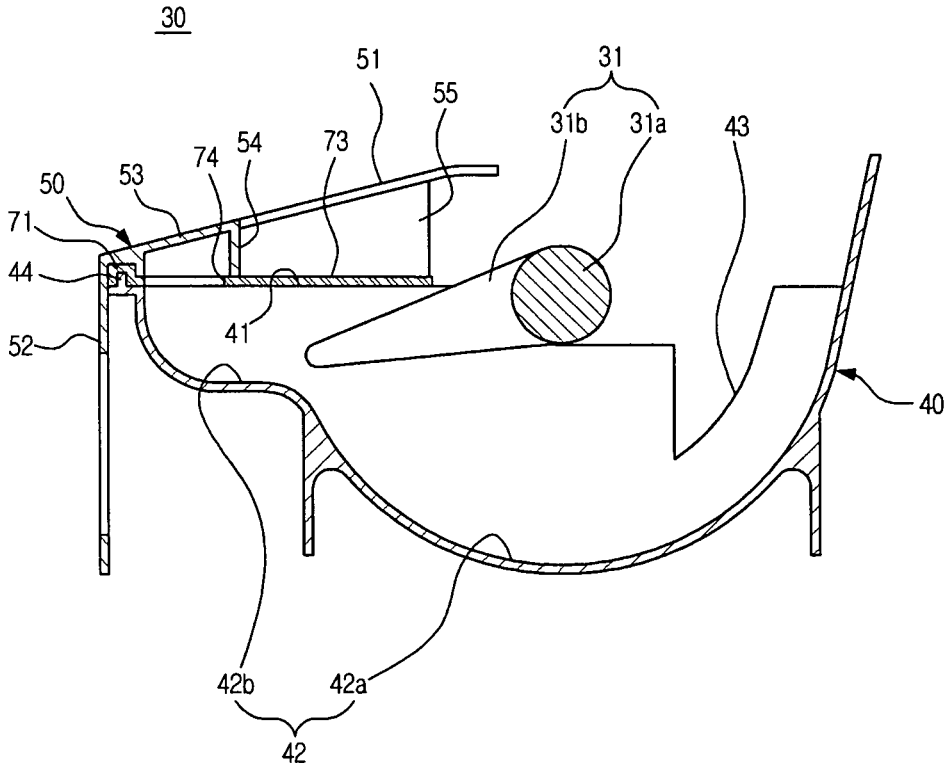
FIG. 4 illustrates a cross-sectional view showing the ice maker included in an exemplary embodiment.

FIG. 3 illustrates an exploded perspective view showing the ice maker of the ice making apparatus of FIG. 2. FIG. 4 illustrates a cross-sectional view showing the ice maker included in an exemplary embodiment.

As shown in FIGS. 3 and 4, the ice making tray 40 serving as an ice producing space in the refrigerator according to an exemplary embodiment is cast of metal such as aluminum having a high thermal conductivity. A plurality of partition walls 41 are disposed at specified intervals in the ice making tray 40. A plurality of ice making cells 42 are defined in the ice making tray 40 by the partition walls 41. A communication part 43 is formed on the partition walls 41 to uniformly maintain a water supply amount of water supplied to each of the ice making cells 42. Accordingly, the water supplied into the ice making tray 40 from a water supply pipe 65 is introduced into the adjacent ice making cells 42 through the communication part 43 to uniformly maintain the water supply amount between the respective ice making cells 42.

The ejector 31 is installed at an upper portion of the communication part 43 to discharge the ice produced in the ice making tray 40 to the outside of the ice making tray 40.

The ejector 31 includes a rotation shaft 31*a* which is rotated by a driving device (not shown) and a plurality of scrapers 31*b* installed at specified intervals along the rotation shaft 31*a* to correspond to the plural ice making cells 42. Accordingly, when the rotation shaft 31*a* is rotated, each of the scrapers 31*b* pushes the ice produced in each of the ice making cells 42 to discharge the ice to the outside of the ice making tray 40.

Each of the ice making cells 42 includes a freezing portion 42*a* in which the supplied water is frozen and a buffering portion 42*b* which is extendedly formed at a front upper portion of the freezing portion 42*a* to prevent the outflow of water supplied to the freezing portion 42*a*.

The freezing portion 42*a* is disposed at a lower portion of the ice making tray 40 and formed in a circular arc shape having a specified radius such that the ice can be easily separated from the freezing portion 42*a* by the rotation of the ejector 31.

The buffering portion 42*b* is bent toward the outside of the radius of the freezing portion 42*a* at a front end portion of the freezing portion 42*a* to form a buffering space capable of accommodating a specified amount of water. Accordingly, when water flows due to opening/closing of the freezing chamber door 12 or the like, some water accommodated in the freezing portion 42*a* flows into the buffering portion 42*b*. The buffering portion 42*b* functions as a temporary storage space to accommodate water, thereby preventing water from rising along an inner surface of the ice making tray 40 and flowing out of the ice making tray 40.

Figure 5A:
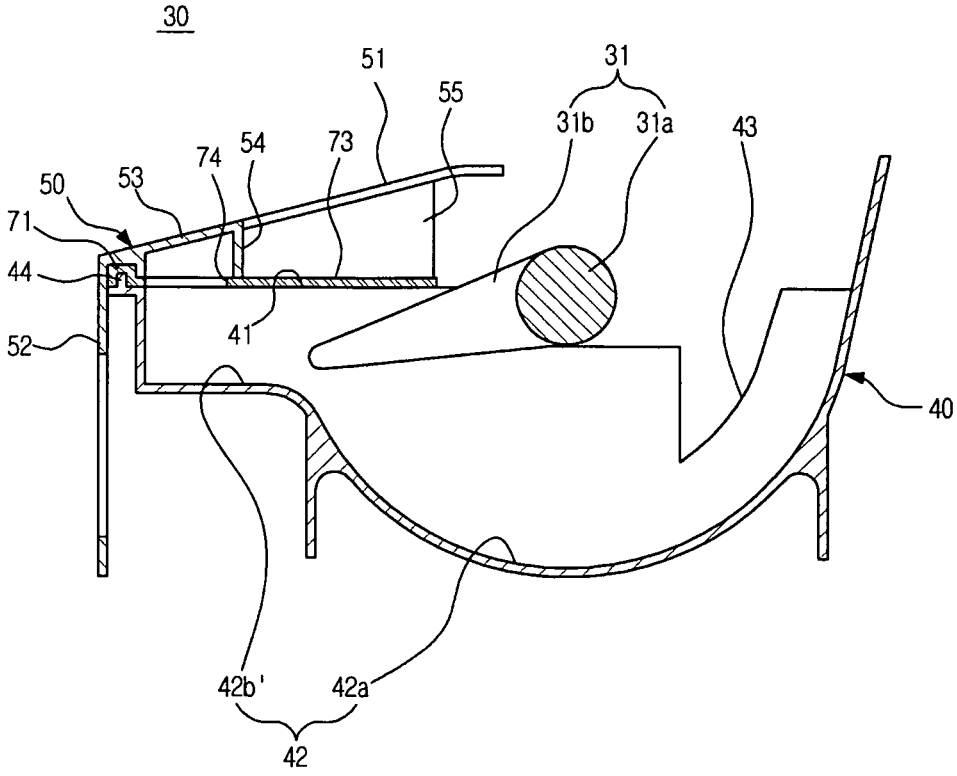
FIGS. 5A and 5B illustrate cross-sectional views showing modified examples of the ice maker included in an exemplary embodiment.
Figure 5B:
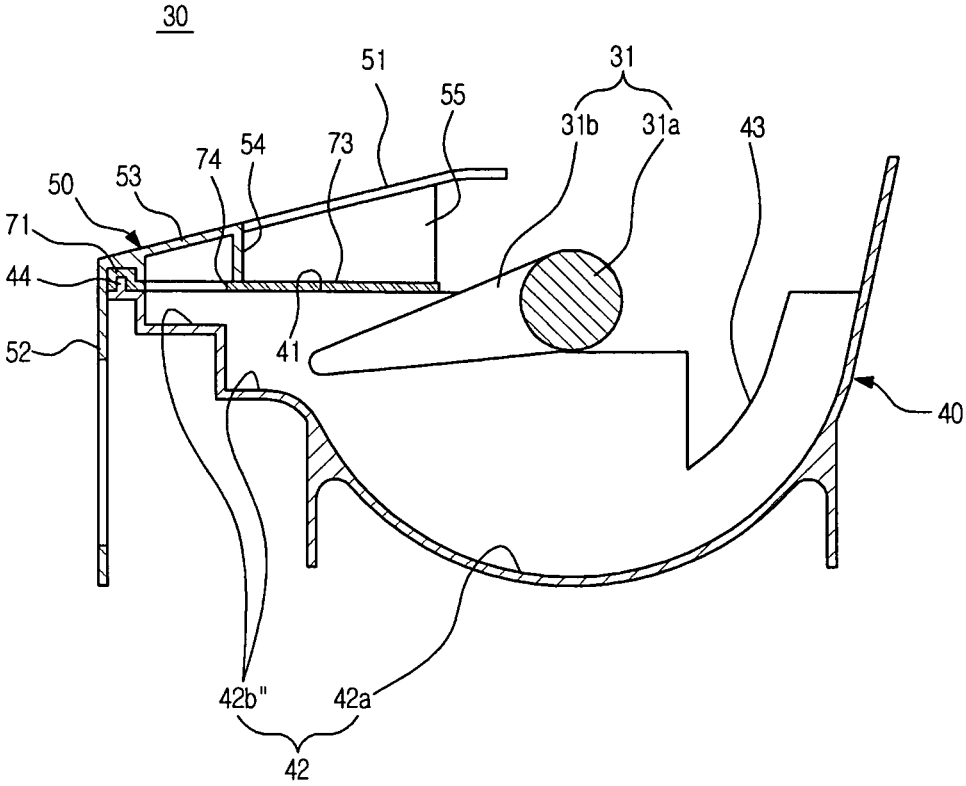

FIGS. 5A and 5B illustrate cross-sectional views showing modified examples of the ice maker included in an exemplary embodiment.

In this case, as shown in FIG. 4, a sectional shape of the buffering portion 42*b* may be formed in an arc shape having a curvature radius smaller than a curvature radius of the freezing portion 42*a*. A buffering portion 42*b*' may be formed in an approximately "L" shape as shown in FIG. 5A, or a buffering portion 42*b*" may be formed in a stepped shape as shown in FIG. 5B. As described above, the buffering portion may be formed in various sectional shapes in modified examples, wherein the buffering portion is bent from an upper end of the freezing portion 42*a* to form a space capable of accommodating a portion of water flowing out of the freezing portion 42*a*.

Further, the ice making tray 40 is cast by forming the freezing portion 42*a* and the buffering portion 42*b* as a single body. Accordingly, although water flows due to the opening/closing or the like of the freezing chamber door 12, it is possible to prevent the outflow of water in the ice making tray 40 to a certain extent. In this case, when water flows to a great extent, water may flow out through an upper end of the buffering portion 42*b*. In order to prevent such an outflow of water, a buffering portion cover 53 capable of blocking a water outflow is provided at the upper end of the buffering portion. Although the buffering portion cover 53 may be separately provided and coupled to an upper or lower portion of the tray cover, the buffering portion cover 53 is formed at the tray cover 50 as a single body in this exemplary embodiment. That is, the buffering portion cover 53 is provided between the ice guiding portion 51 of the tray cover 50 and the lever protecting portion 52.

The buffering portion cover 53 covers an upper portion of the buffering portion 42*b* to prevent the outflow of water. The buffering portion cover 53 is formed to have a specified width substantially equal to the width of the buffering portion 42*b* to cover the upper portion of the buffering portion 42*b*. When water flows out of the upper end of the buffering portion 42*b* due to a centrifugal force caused by a fast rotation of the door 12 or a strong impact caused by the opening/closing of the door 12, it is possible to prevent water from flowing out of the ice making tray 40 by the buffering portion cover 53.

Thus, the buffering portion 42*b* is extendedly formed at the outside of the radius of the freezing portion 42*a*, that is, at the front side of the ice making tray 40. The buffering portion cover 53 covers the upper portion of the buffering portion 42*b*. Accordingly, it is possible to prevent water introduced into the buffering portion 42*b* from flowing out of the ice making tray 40 without interfering with the rotation of the scrapers 31*b*.

Further, preferably, the ice making apparatus 20 included in an exemplary embodiment includes a water outflow prevention member 70 between the buffering portion 42*b* and the buffering portion cover 53, thereby improving a water outflow prevention effect.

The water outflow prevention member 70 is formed of an elastic material such as rubber or silicon. The water outflow prevention member 70 includes a sealing portion 71 which is fixed to a flange portion 44 formed on a front upper surface of the ice making tray 40 to prevent water from leaking through a gap between the upper end of the buffering portion 42*b* and the tray cover 50, and a sheet portion 73 having a plurality of cutaway portions 72 formed corresponding to the scrapers 31*b* such that the scrapers 31*b* of the ejector 31 pass through the cutaway portions 72 while being in contact therewith.

Also, when water flows in the water outflow prevention member 70, the water may pass over the water outflow prevention member 70 through the cutaway portions 72 and the like. When the water remains and freezes on an upper portion of the water outflow prevention member 70, the sheet portion 73 may be torn by the rotation of the scrapers 31*b*.

Figure 6:
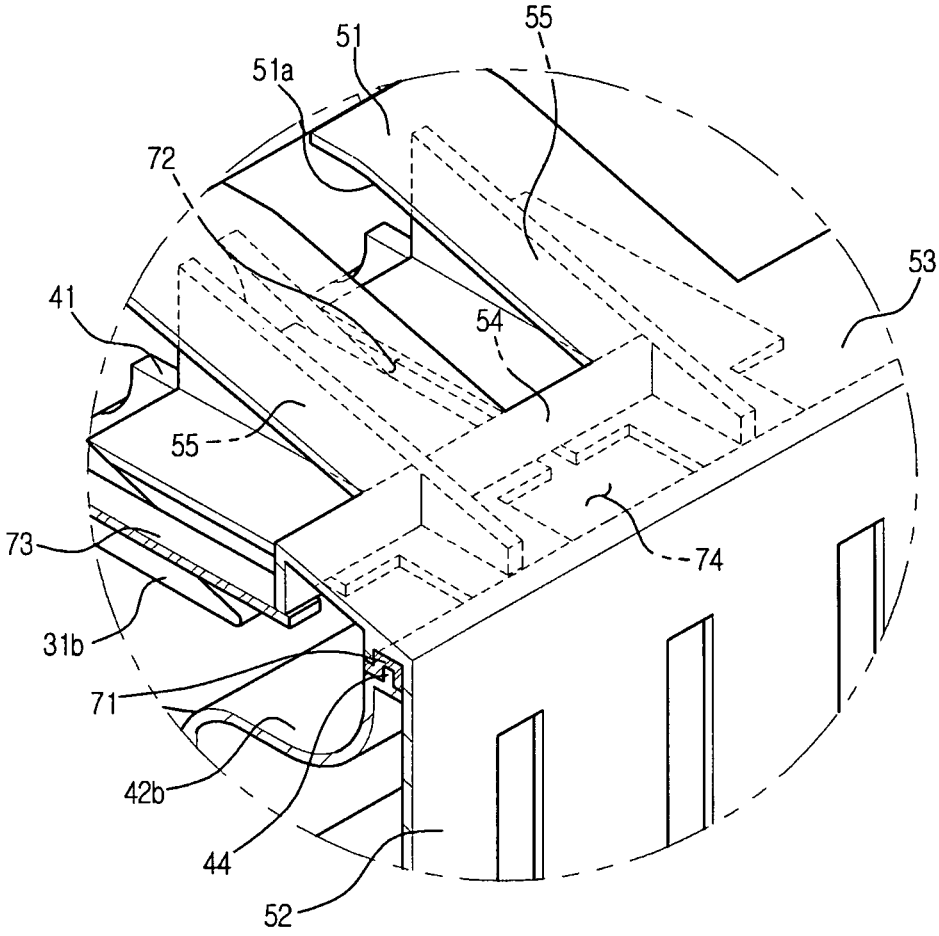
FIG. 6 illustrates an enlarged view showing a main part of FIG. 2.

In order to prevent such a problem, as shown in FIGS. 4 and 6, through holes 74 are formed between the plural cutaway portions 72 and the sealing portion 71 such that water can flow up and down through the water outflow prevention member 70.

The water positioned at the upper portion of the water outflow prevention member 70 due to the flowing of water is reintroduced into the ice making tray 40 through the through holes 74. Accordingly, it is possible remove the water from the upper portion of the water outflow prevention member 70, thereby preventing the freezing of the water outflow prevention member 70.

In this case, a first rib and a second rib 54 and 55 are disposed at a lower portion of the buffering portion cover 53 to cover the respective through holes 74 in order to prevent the water, which is introduced into the upper portion of the water outflow prevention member 70 through the through holes 74 due to the water flow caused by the opening/closing of the door 12 or the like, from flowing out of the ice making tray 40.

In the coupling of the ice making tray 40, the water outflow prevention member 70 and the tray cover 50, first, the sealing portion 71 of the water outflow prevention member 70 is coupled to the flange portion 44 formed at the upper end of the ice making tray 40. In this case, the central side of the sheet portion 73 is supported by the partition walls 41 of the ice making tray 40 and the second rib 55 of the tray cover 50, thereby firmly fixing the water outflow prevention member 70.

Hereinafter, a water outflow prevention structure of the ice making apparatus according to an exemplary embodiment will be described with reference to the accompanying drawings.

Figure 7:
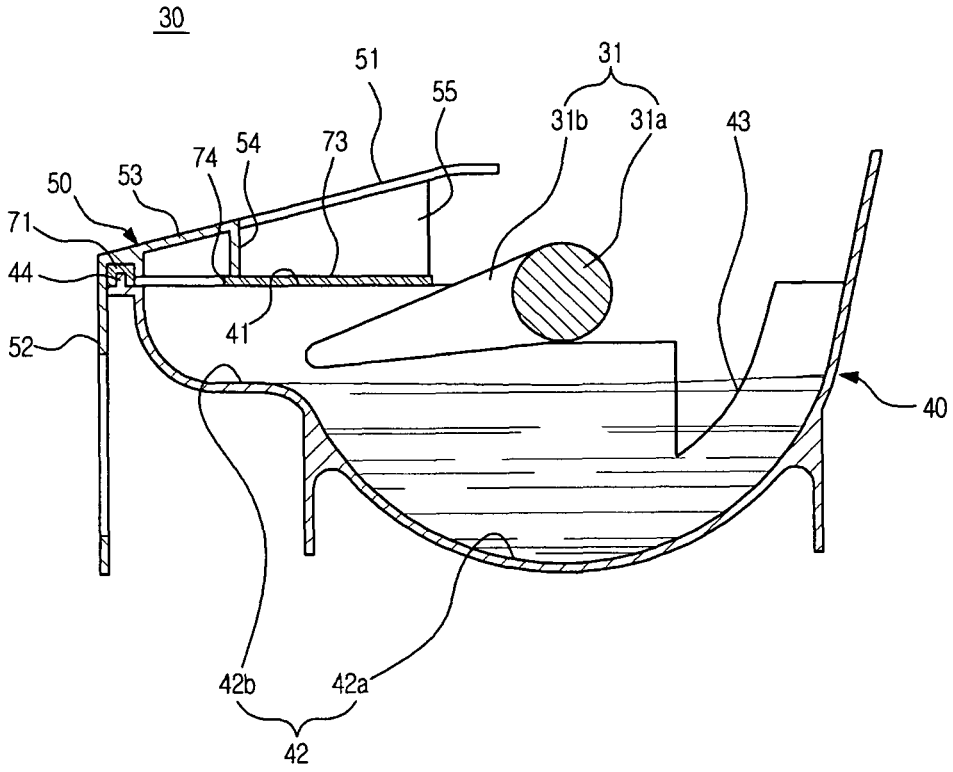
FIG. 7 illustrates a cross-sectional view showing a state in which water is supplied into an ice making tray included in the refrigerator according an exemplary embodiment.
Figure 8:
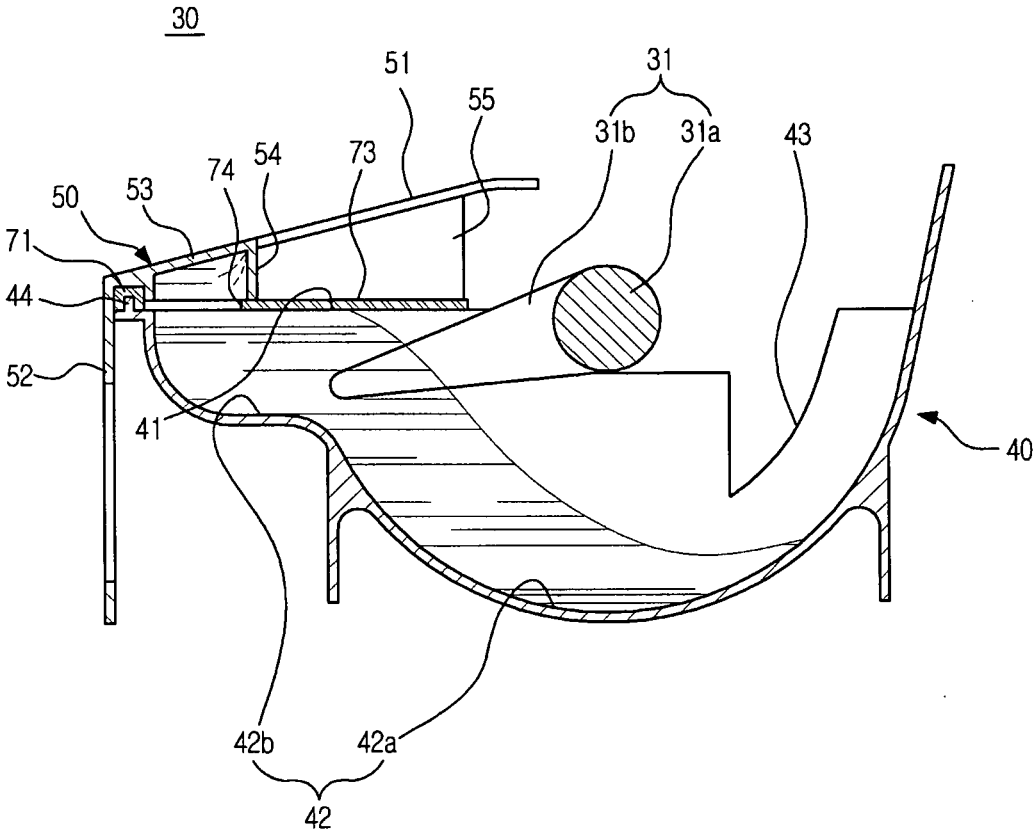
FIG. 8 illustrates a cross-sectional view showing a case in which the flowing of water is generated in the ice making tray of FIG. 7.

FIG. 7 illustrates a cross-sectional view showing a state in which water is supplied into the ice making tray included in the refrigerator according to an exemplary embodiment. FIG. 8 illustrates a cross-sectional view showing a case in which the flowing of water is generated in the ice making tray of FIG. 7.

When the water supply into the ice making tray 40 through a water supply cup 64 is completed, as shown in FIG. 7, water is accommodated in the freezing portion 42*a*. In this case, when the flowing of water is generated due to the opening/closing of the door 12 or the like and water flows toward the rear side of the ice making tray 40, a guide 61*a* of the upper distribution plate 61 prevents water from flowing out of the ice making tray 40.

Further, when water flows toward the front side of the ice making tray 40, as shown in FIG. 8, water flows into a specified space of the buffering portion 42*b* to relieve a rapid flow of water, thereby preventing the outflow of water. The water flowing over the upper end of the buffering portion 42*b* is prevented again from flowing out by the water outflow prevention member 70. The water introduced into the through holes 74 of the water outflow prevention member 70 is blocked from being discharged to the outside by the first and second ribs 54 and 55 formed at the lower side of the buffering portion cover 53.

The water which has been blocked from being discharged to the outside by the first and second ribs 54 and 55 is reintroduced into the ice making tray 40 through the through holes 74, thereby preventing the water from remaining on the water outflow prevention member 70.

Thus, also when the water accommodated in the ice making cells 42 rapidly flows, there is an effect of preventing water from flowing out of the ice making tray 40 by the buffering portion 42*b*, the buffering portion cover 53 and the water outflow prevention member 70.

As described above, the ice making apparatus and the refrigerator having the same according to an exemplary embodiment permanently provide an effect of preventing water from flowing out of the ice making tray even when the water flows by providing the buffering portion at the ice making tray.

Further, an exemplary embodiment can improve a water outflow prevention effect by providing the buffering portion cover at an upper portion of the buffering portion.

Further, an exemplary embodiment can improve a water outflow prevention effect by providing the water outflow prevention member between the ice making tray and the tray cover. Moreover, an exemplary embodiment has an effect of preventing the sheet portion from being torn by forming the through holes at the water outflow prevention member to prevent water from remaining on the water outflow prevention member.

Although a few exemplary embodiments have been shown and described, it would be appreciated by those skilled in the art that changes may be made in these exemplary embodiments, the scope of which is defined in the claims and their equivalents.

What is claimed is:

1. A refrigerator comprising:

a storage chamber;

a door to open and close the storage chamber; and an ice making apparatus disposed at an inner surface of the door, wherein the ice making apparatus includes an ice making tray mounted to the door to extend in a longitudinal direction, an ejector to separate, from the ice making tray, ice produced in the ice making tray, and a tray cover to downwardly guide the ice separated from the ice making tray in accordance with an operation of the ejector, wherein the ice making tray includes a plurality of ice making cells defined in the ice making tray by a plurality of partition walls, wherein each of the ice making cells includes a freezing portion in which water supplied to the freezing portion is frozen to produce ice, and a buffering portion extending radially outwardly from the freezing portion to provide a buffering space to temporarily receive an amount of water flowing in accordance with opening and closing of the door, wherein the tray cover further includes a buffering portion cover supported by the plurality of partition walls to cover an upper part of the buffering portion to prevent water in the buffering portion from flowing out of the ice making tray and to prevent water in the buffering portion of one of the ice making cells from flowing to the buffering portion of another one of the ice making cells.

2. The refrigerator according to claim 1, wherein the freezing portion has a specified radius and the buffering portion is disposed at an outside of the radius of the freezing portion in a direction away from the door.

3. The refrigerator according to claim 1, wherein the tray cover and the buffering portion cover are formed to have an integral structure.

4. The refrigerator according to claim 1, wherein each of the partition walls includes a communication part to uniformly distribute water supplied to the ice making cells.

5. The refrigerator according to claim 1, further comprising:

a water outflow prevention member disposed between the tray cover and the ice making tray to allow the ejector to pass through the water outflow prevention member and to be restored after passage of the ejector to prevent water from passing through the water outflow prevention member, wherein the water outflow prevention member includes a cutaway portion to allow the ejector to pass through the water outflow prevention member, and a groove portion formed at one side of the cutaway portion to prevent the cutaway portion from being torn and to allow water remaining on an upper surface of the water outflow prevention member to be reintroduced into the ice making tray.

6. The refrigerator according to claim 1, wherein the ice making apparatus further includes an upper distribution plate to cover a portion of a region extending over the plurality of ice making cells, the upper distribution plate preventing water in the ice making cells from flowing out of the ice making tray.

7. The refrigerator according to claim 5, wherein the buffering portion cover includes a first rib downwardly protruded in the longitudinal direction of the ice making tray to prevent the water in the buffering portion from flowing out of the tray cover, and a second rib supported by the plurality of partition walls to prevent the water in the buffering portion of one of the ice making cells from flowing to the buffering portion of another one of the ice making cells.

8. The refrigerator according to claim 1, wherein the freezing portion has an arc-shaped cross section having a specified curvature radius, and the buffering portion has a cross section having a curvature radius different from the curvature radius of the freezing portion at one side of the freezing portion.

9. The refrigerator according to claim 7, wherein the water outflow prevention member has an upper surface to be in contact with a portion of an upper end of each of the partition walls in a sealed fashion, and a lower surface to be in contact with a portion of the second rib.

10. The refrigerator according to claim 1, further comprising:

an ice bank mounted to the inner surface of the door beneath the ice making apparatus; and an ice fullness lever to measure an amount of ice stored in the ice bank, wherein the tray cover includes an ice guiding portion formed with an ejector groove to prevent the tray cover from interfering with rotation of the ejector, and a lever protecting portion to protect the ice fullness lever.

11. A refrigerator comprising:

a storage chamber;

a door to open and close the storage chamber; and an ice making apparatus disposed at an inner surface of the door, wherein the ice making apparatus includes an ice making tray mounted to the door to extend in a longitudinal direction, an ejector to separate, from the ice making tray, ice produced in the ice making tray, and a tray cover to downwardly guide the ice separated from the ice making tray in accordance with an operation of the ejector, wherein the ice making tray includes a plurality of ice making cells defined in the ice making tray by a plurality of partition walls, wherein each of the ice making cells includes a freezing portion in which water supplied to the freezing portion is frozen to produce ice, and a buffering portion extending radially outwardly from the freezing portion to provide a buffering space to temporarily receive an amount of water flowing in accordance with opening and closing of the door, wherein the tray cover includes an ice guiding portion formed with an ejector groove so as not to interfere with rotation of the ejector, and a buffering cover portion extending from the ice guiding portion to cover an upper part of the buffering portion, wherein the ice guiding portion is disposed over the freezing portion, and the buffering cover portion is disposed over the buffering portion.

12. The refrigerator according to claim 11, wherein the buffering cover portion is supported by the plurality of partition walls to prevent water in the buffering portion of one of the ice making cells from flowing to the buffering portion of another one of the ice making cells.

13. The refrigerator according to claim 11, wherein the freezing portion has an arc-shaped cross section having a specified curvature radius, and the buffering portion has a cross section having a curvature radius different from the curvature radius of the freezing portion at one side of the freezing portion.

14. The refrigerator according to claim 11, wherein the buffering portion has an L-shape.

15. The refrigerator according to claim 11, wherein the buffering portion has a stepped shape.

16. The refrigerator according to claim 11, further comprising:

a water outflow prevention member disposed between the tray cover and the ice making tray, the water outflow prevention member being elastically deformable to allow the ejector to pass through the water outflow prevention member and to be elastically restored after passage of the ejector, wherein the water outflow prevention member includes a cutaway portion to allow the ejector to pass through the water outflow prevention member, and a groove portion formed at one side of the cutaway portion to prevent the cutaway portion from being torn and to allow water remaining on an upper surface of the water outflow prevention member to be reintroduced into the ice making tray.

17. The refrigerator according to claim 11, wherein the ice making apparatus further includes an upper distribution plate to cover a portion of a region extending over the plurality of ice making cells, the upper distribution plate preventing water in the ice making cells from flowing out of the ice making tray.

18. The refrigerator according to claim 11, wherein the buffering portion cover includes a rib downwardly protruded in the longitudinal direction of the ice making tray to prevent water in the buffering portion from flowing out of the tray cover.

19. The refrigerator according to claim 11, wherein the buffering portion cover includes a rib supported by the plurality of partition walls to prevent the water in the buffering portion of one of the ice making cells from flowing to the buffering portion of another one of the ice making cells.

* * * * *